United States Patent [19]

Quang et al.

[11] 4,213,048

[45] Jul. 15, 1980

[54] METHOD AND CIRCUIT ARRANGEMENT FOR IMPROVING THE RADIOLOGICAL DEFINITION OF THE FOCAL SPOTS OF X-RAY TUBES

[75] Inventors: Dang T. Quang; Jacques Leguen; Jacques Delair, all of Paris, France

[73] Assignee: Compagnie Generale de Radiologie, Paris, France

[21] Appl. No.: 952,352

[22] Filed: Oct. 18, 1978

[30] Foreign Application Priority Data

Oct. 21, 1977 [FR] France ..... 77 31743

[51] Int. Cl.[2] ..... H05G 1/00

[52] U.S. Cl. ..... 250/402; 313/57

[58] Field of Search ..... 250/401, 402, 403, 404, 250/405; 313/57

[56] References Cited

U.S. PATENT DOCUMENTS

| | | | |
|---|---|---|---|
| 2,862,107 | 11/1958 | Cummings | 250/403 |
| 3,743,836 | 7/1973 | Holland et al. | 250/405 |
| 3,992,633 | 11/1976 | Braun et al. | 250/503 |

*Primary Examiner*—Alfred E. Smith
*Assistant Examiner*—Thomas P. O'Hare
*Attorney, Agent, or Firm*—Edwin E. Greigg

[57] ABSTRACT

A method and circuit arrangement for improving the definition of the focal spots of X-ray tubes which comprises periodically varying the bias voltage applied to the concentrating electrode of the tube, focalizing the eletron beam emitted by the filament, between a negative minimum or zero value and a negative maximum value, with a voltage waveform whose frequency is higher than 10 kilohertz, wherein this bias voltage has to assume at least the two extreme values frequently, while a direct-current high voltage is being applied between the cathode (filament) and the anode (target) during the exposure time.

10 Claims, 3 Drawing Figures

METHOD AND CIRCUIT ARRANGEMENT FOR IMPROVING THE RADIOLOGICAL DEFINITION OF THE FOCAL SPOTS OF X-RAY TUBES

The present invention relates to a method of and a circuit arrangement for improving the radiological quality or definition of the focal spots, i.e. the target area bombarded by electrons, of X-ray tubes.

Figure 1:
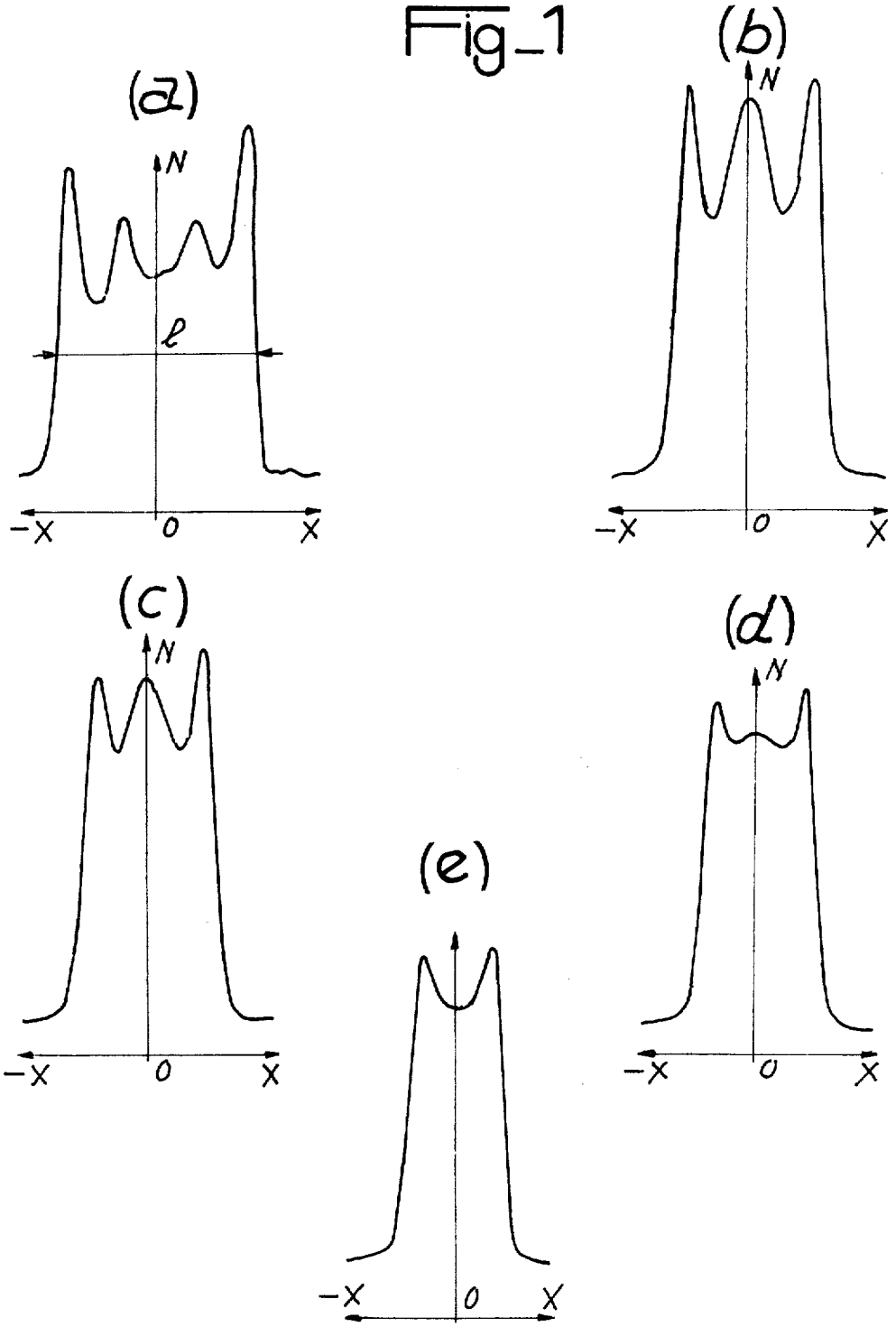

The quality of an X-ray image is related, inter alia, to the size of the focal spot of the X-ray tube. The finer the focus the smaller is the geometric blurring. The effective dimensions of focal spots may be determined by the pin-hole method or by the modulation transfer function (MTF) method using test patterns. This second method has the advantage of also providing an illustration of the electron distribution at the focal area. However, it is known that the radiological quality of a focal spot of given nominal size is also related to the uniformity of this distribution. When radiographic images of the X-ray tube focal spots are examined, in most, if not all, cases major concentrations of electrons or "bars", are found along the two sides which define the focal area in the transverse direction. A microdensitometric section of such radiographic images reveals on a densitogram two or more peaks and one or more very pronounced valleys, as is shown in FIG. 1 of the accompanying drawings, which represents diagrams of the distribution of incident electrons (N being the number of electrons) along a cross-section of the focal spot (X being the distance from the longitudinal axis of the focal spot).

Also, the dimensions measured by the pin-hole method are always smaller than those determined by the MTF method from test patterns. However, for some time past, radiologists have frequently made use of this latter method to check the quality of the focal spots of X-ray tubes. To satisfy the demands of users, X-ray tube manufactures are obliged to make a selection of the foci or to replace the tubes until the customer is satisfied, which results in a loss of time, money and prestige to the reputation of the manufactures, notwithstanding the dimensional conformity of the focal spots with most of the currently applied standards based on the pin-hole method.

The size of foci may be reduced by applying a negative biasing voltage $V_p$ to the component for concentrating the electron beam emitted by the filament, which is formed by a cup-shaped electrode surrounding the filament on its side opposed to the one facing the target. The higher the absolute value of this voltage, the more the width of the focus, and to a lesser extent its length, decreases, that is to say the more the two "bars" defining the width of the focus approach each other. They are coincident for a certain value of the bias voltage. FIG. 1 of the accompanying drawing, gives the width 1 and the transverse electron distribution of the focal spot of the same X-ray tube for several bias voltage values. It is moreover possible, in the case where the electrode is divided into two parts which are insulated relatively to each other, to reduce the two dimensions at the same time by applying thereto respectively two bias voltages of different values in the two dimensions. However, in the prior art, the negative bias voltage applied to the concentrating electrode remains constant. Further, as the area of the of the focal spot is thus reduced, the admissible loading of the tube must be reduced accordingly.

In the U.S. Pat. No. 3,992,633, there is disclosed a fixed target X-ray tube having a cathode of substantially circular shape which is indirectly heated and a large size (diameter) and emits, towards the target which is of comparable size, an electron beam of large diameter. In one of the embodiments, the tube is surrounded by a concentrating coil which acts on the concentration of the electron beam in accordance with the current flowing therethrough. The periodic variation of this current results in a periodic contraction and spreading of the electron flux striking the target so as to compensate for irregularities in the beam. In another embodiment, the X-ray tube further comprises an additional electrode, termed grid, of cylindrical or annular shape disposed about half way between the cathode and the target and surrounding the electron beam so as to act simultaneously on the concentration of the electron flux and on the intensity thereof. The pulsed modulation of the bias voltage of the grid therefore acts on the current intensity and on the dimension of the focal spots in the opposite sense. An arrangement of conventional deflecting coils producing orthogonal magnetic fields also enables the target to be scanned by the electron beam to uniformly bombard its surface.

In French Pat. No. 1,057,152, filed Apr. 4, 1952 by COMPAGNIE FRANCAISE THOMSON-HOUSTON claiming the priority of U.S. Pat. application of Cummings, filed Apr. 6, 1951, now U.S. Pat. No. 2,862,107, there is described a method for controlling an X-ray tube connected in a self-rectifying circuit to the very high voltage winding of a transformer fed by the a.-c. mains. The tube comprises a concentrating electrode associated with a grid which shields the filament on its side facing the target. This grid, which is insulated from the filament, is fed by another winding of the transformer delivering a voltage which is substantially in phase opposition with the a.-c. voltage supplied by the high-voltage winding connected respectively to the anode and the cathode of the tube. One terminal of this other winding is connected to the grid through a parallel resistor capacitor network so as to obtain a grid bias voltage including an a.-c. component supplied by the winding and a negative d.-c. component produced by the grid current during the positive half-cycles of the a.-c. component. The cathode and the grid are then equivalent to a rectifier diode since the anode-to-cathode voltage is then negative and there is no anode current. During the positive half-cycles of the anode-to-cathode voltage, the grid bias voltage becomes all the more negative as the potential of the anode becomes positive, thereby producing a relative stabilization of the current and of the dimensions of the focal spot.

It is an object of the invention to overcome or to reduce the drawbacks of the constant bias of the concentrating electrode in an X-ray tube having a thin linear filament forming its cathode. While keeping the overall dimensions as measured by the pin-hole method constant, it enables the electron distribution of the focal spot to be modified in such a way that the dimensions as determined by the modulation transfer function method using test patterns, can be adjusted to values equal to, less than, or very much (up to 50%) less than the dimensions determined by the pin-hole method.

According to the invention, there is provided a method for improving the radiological definition of focal spot of an X-ray tube, wherein the bias voltage of the concentrating electrode is periodically varied between a negative minimum or zero value and a negative maximum value with a frequency such that each duration of the X-ray tube operation comprises a plurality of periods of variation of the bias voltage. In this way, the electron beams give rise to bars which may scan the entire area of the focal spot so as to achieve a substantially uniform electron distribution thereover.

According to another feature of the invention, the frequency of variable bias voltage waveform is about 10, preferably between 20 and 60 kilohertz.

The invention also concerns a device for carrying out the method defined hereinbefore.

Figure 2:
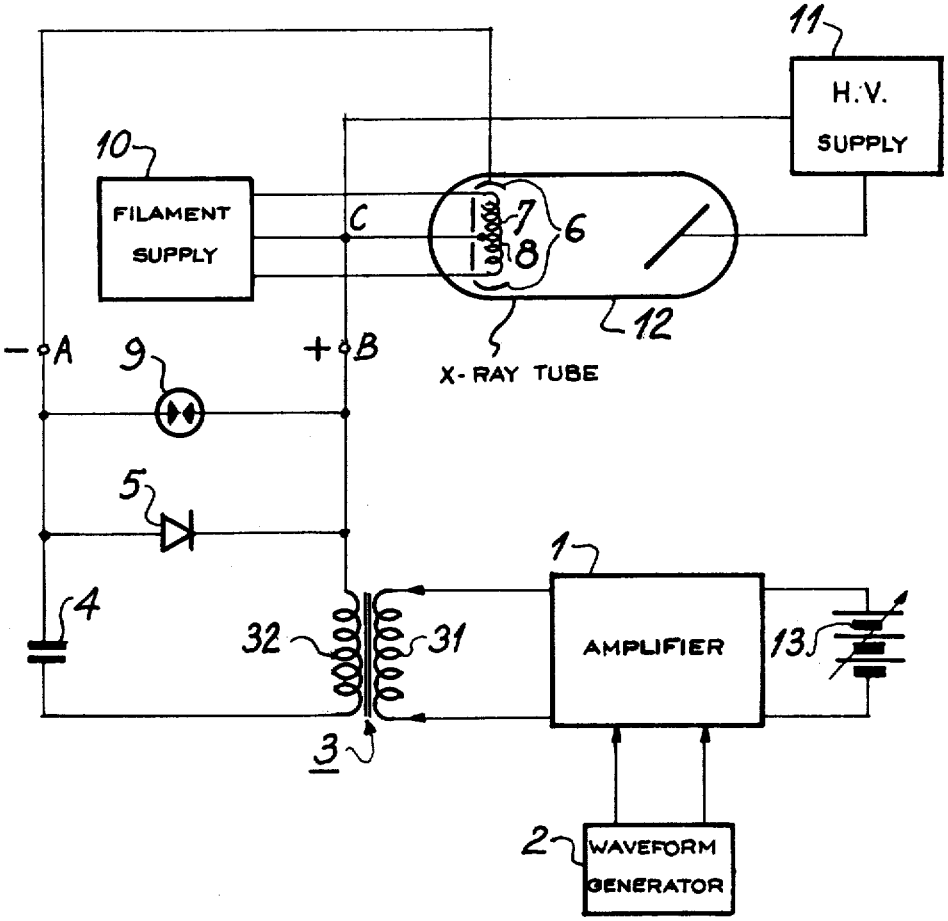
Figure 3:
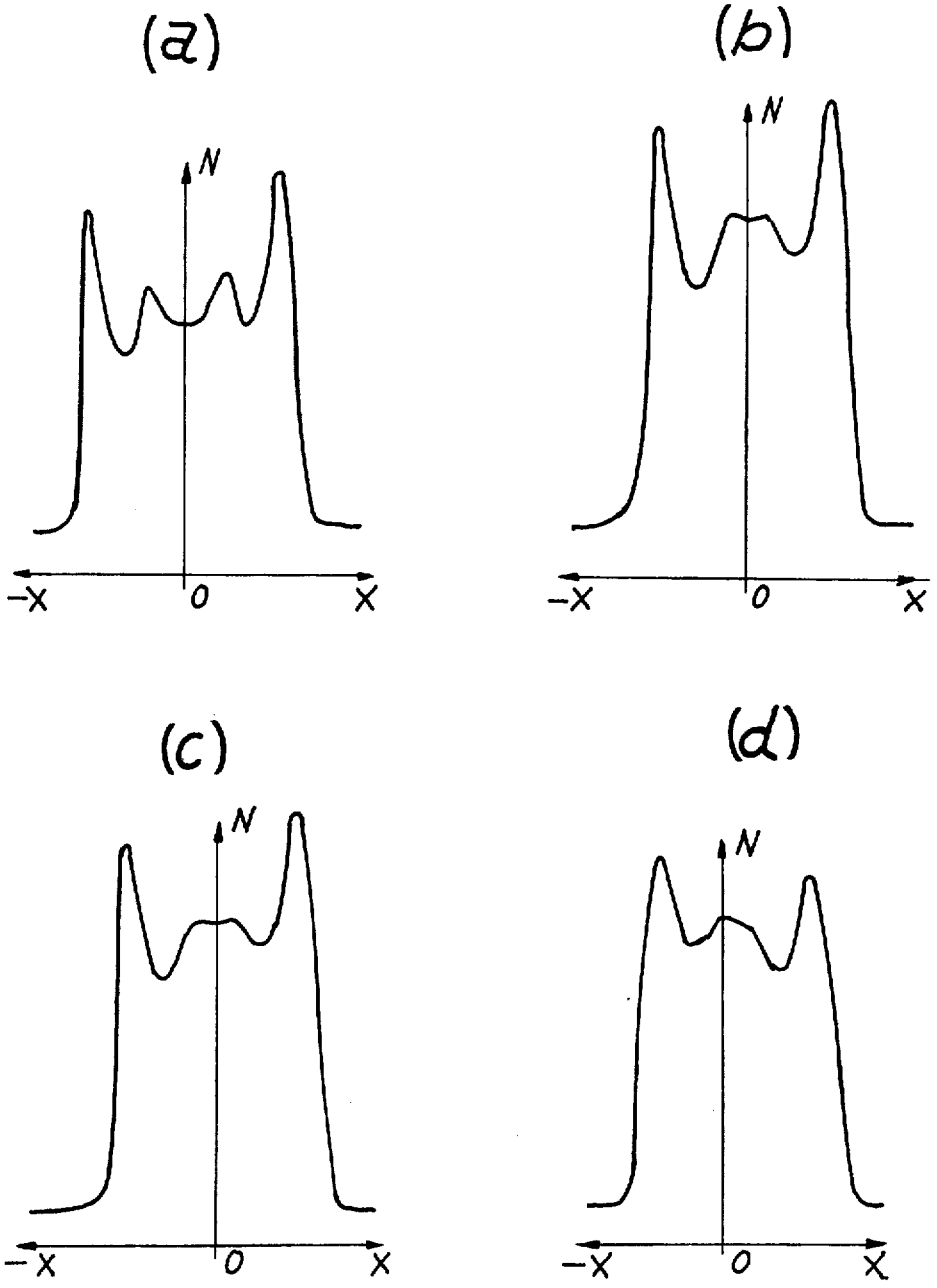
Figure 3:
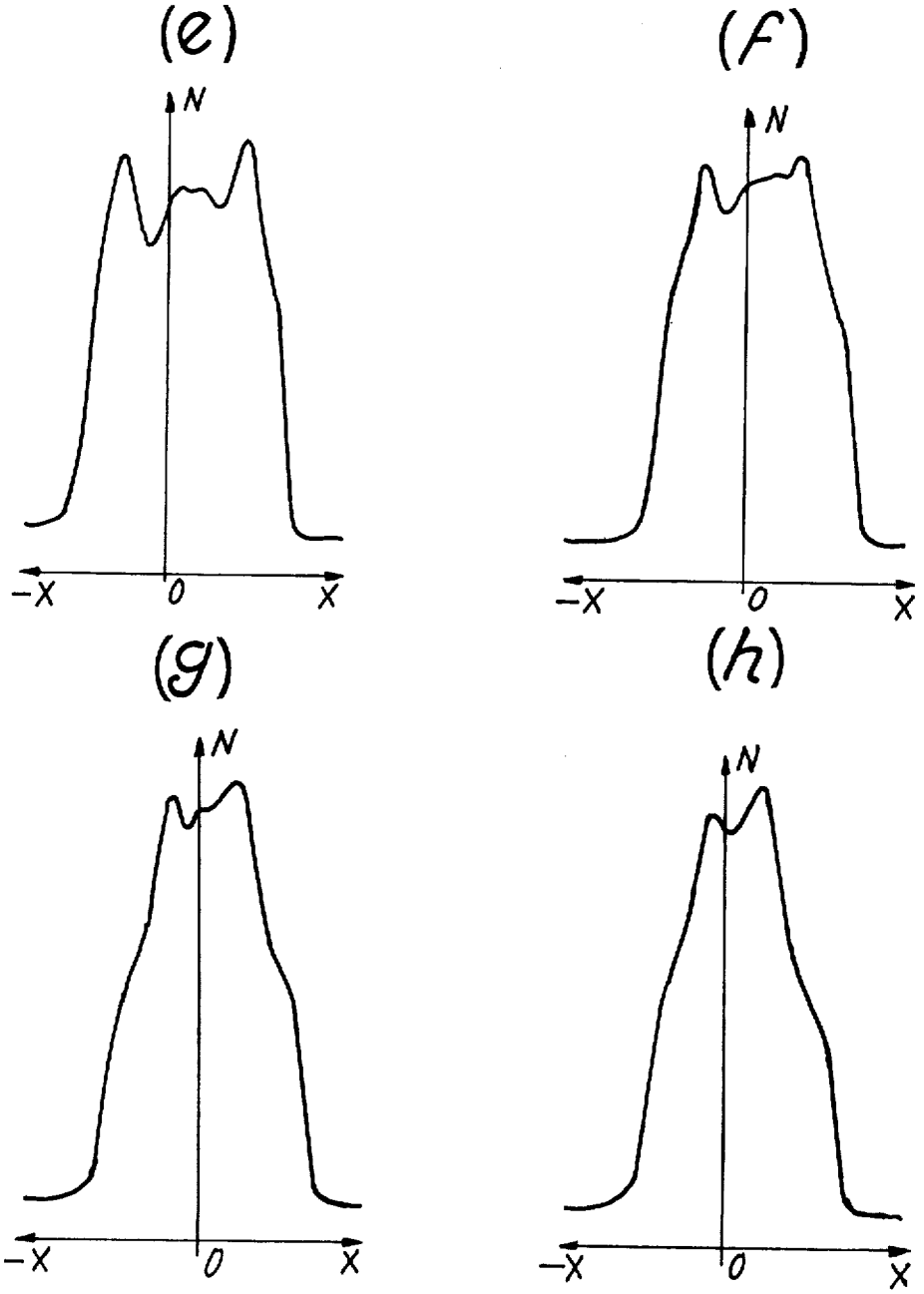

Other objects and advantages of the invention will become be apparent from the ensuing description which is given by way of a non-limitative example, with reference to the accompanying drawings, in which:

FIGS. 1 (*a*) to 1 (*e*) represent respectively densitometric distribution curves for several values of bias voltage of the concentrating electrode, obtained without using the method of the invention;

FIG. 2 shows schematically a circuit for varying the bias voltage of the concentrating electrode of an X-ray tube; and FIGS. 3 (*a*) to 3 (*h*) represent respectively densitometric distribution curves obtained for a modulation frequency of 20 kHz for different amplitudes (peak values) of the variable bias voltage of the concentrating electrode.

FIGS. 1 (*a*) to 1 (*e*) respectively show densitometric distribution curves of the electrons in the transverse direction of a rectangular focal spot for several values of the bias voltage $V_p$ of the concentrating electrode. It can be seen therefrom that the width 1 at half the peak value of N and the spacing and the number of peaks (bars) and valleys varies substantially inversely with the absolute value of the negative bias voltage.

FIG. 1 (*a* ) gives for a zero voltage $V_p$, a width 1 of 1.45 mm with four peaks (and three minima), the extreme ones of which have high amplitudes. FIG. 1 (*b*) gives for a bias voltage $V_p$ of $-100$ V, a width 1 of 1.09 mm with three peaks (two minima) of substantially equal heights. FIG. 1 (*c*) was obtained with a bias voltage $V_p$ of $-200$ V and it gives a width 1 of 0.91 mm with three peaks of smaller amplitude. FIG. 1 (*d*) gives for a bias voltage $V_p$ of $-300$ V, a width 1 of 0.78 mm with substantially two peaks of still smaller amplitude, and FIG. 1 (*e*) gives, for a voltage $V_p$ of $-400$ V, a width 1 of 0.65 mm with two peaks (maxima) of reduced amplitudes with a single centrally located minimum (or valley).

These diagrams of FIGS. 1 (*a*) to 1 (*e*) show that, by using during the exposure time (operation time of the X-ray tube) two or more values of the bias voltage of the concentrating electrode for substantially equal periods of time, it is possible to render the densitometric distribution of the focal spot more uniform. By varying the bias voltage $V_p$ between O V and $-200$ V, for example by means of a square wave, it can be seen that in superposing the FIGS. 1 (*a*) and 1 (*c*), there is obtained a width 1 of the focal spot, of about 1.45 mm with peaks and hollows of reduced amplitudes and therefore a substantially more uniform distribution for the entire exposure time.

The method according to the invention comprises varying or modulating, while a direct-current high voltage is being applied between the cathode and the anode during the exposure time, the bias voltage of the concentrating electrode relatively to the cathode, which is normally negative relative to or at the same potential as the cathode, with a voltage waveform whose frequency is higher than 10 kHz and preferably between 20 and 60 kHz. This variation may be obtained with different wave-forms namely, square, rectangular, trapezoidal, sinusoidal, triangular, saw-tooth, etc. Tests have shown that bests results are obtained with sinusoidal or triangular waveforms, which are symmetrical relatively to the time axis. The bias voltage will therefore vary between a negative minimum or zero value and a maximum negative value which are chosen experimentally.

Such periodic variations should theoretically allow obtaining a focal area having a substantially uniform electron distribution or a focal spot having a uniform densitometric distribution, that is to say a focus whose densitometric distribution is substantially rectangular or square. Tests carried out have shown that it is possible to obtain such focal spots in particular conditions but that, in most cases, the microdensitometric crosssections of the radiographic images of these focal spots reveal a densitometric distribution starting with two or more peaks (bars) and one or more valleys (hollows) for a zero amplitude polarization voltage, a Gaussian or a triangular distribution being approached when the peak-to-peak amplitude of the polarization voltage is increased while maintaining the overall dimensions of the focus constant. This is illustrated by FIG. 3 and in the following table which shows the widths of the focal spots respectively measured by the pin-hole method and by the test pattern method. The indicated values correspond to a nominal focal width of 1.2 mm, with operation of the tube at half the nominal power (75 kV, 700 mA) and a modulation frequency of 20 kHz and a sinuosoidal (or triangular) voltage waveform.

| A | B | C | D |
|---|---|---|---|
| 0 | 1.45 | 1.75 | a |
| −100 | 1.45 | 1.64 | b |
| −200 | 1.43 | 1.61 | c |
| −300 | 1.43 | 1.51 | d |
| −400 | 1.42 | 1.42 | e |
| −500 | 1.35 | 1.31 | f |
| −600 | 1.35 | 1.19 | g |
| −700 | 1.35 | 1.10 | h |

In the above table:

A indicates the negative peak value of the bias voltage in volts;

B indicates the width measured by the pin-hole method in mm;

C indicates the width measure with the test patterns in mm;

D indicates alphabetic reference of the corresponding densitogram of FIG. 3.

These examples show the interest of the invention which permits, furthermore, the adjusting of the definition of the focal spots of the customer's premises, as well as readusting focal spots whose dimensions with the pin-hole method are not up to standard so as to render them acceptable.

FIG. 2 shows an embodiment of a circuit arrangement for modulating the bias voltage of the concentrating electrode for carrying out the method according to the invention. It comprises an amplifier 1 whose input is fed by the output of a signal generator 2 delivering an a.-c. signal whose amplitude, waveform and frequency may be varied according to needs. The other input of the amplifier 1, which receives a varable d.-c. voltage from a d.-c. voltage source 13, permits varying the gain of the amplifier 1 so as to adjust the peak-to-peak amplitude of the voltage waveform which is to be applied to the concentrating electrode. The output of the amplifier 1 feeds the primary winding 31 of an insulating transformer 3 which insulates the amplifier 1 from the high voltage part of the circuit while transmitting thereto the a.-c. component of its output signal. The secondary winding 32 of the transformer 3 feeds a series network including a capacitor 4 and a diode 5 whose anode is connected to one of the terminals of the secondary winding 32, the free terminal of the capacitor 4 being connected to the other terminal of this winding 32.

This series circuit is equivalent to a half-wave peak rectifier having which produces across the terminals of the capacitor 4 a d.-c. voltage substantially equal to the negative peak value of the a.-c. voltage, with its positive terminal at the junction between the capacitor 4 and the winding 32 and the negative terminal A at the junction between the capacitor 4 and the anode of the diode 5. The cathode of the diode 5 is consequently electrically connected to the positive terminal and its anode to the negative terminal A. Superimposed on this rectified d.-c. voltage is the a.-c. voltage coming from the amplifier 1 which is transmitted through the capacitor 4 and appears with substantially full amplitude across the terminals A and B of the diode 5. The diode 5 here also performs the function of a clamping diode by making the positive peaks of the waveform coincide with the potential of the positive terminal of the capacitor 4, since it only conducts when its anode is positive relative to its cathode.

The positive terminal B of the variable or modulated negative biasing arrangement is connected to the cathode of the X-ray tube 12, more precisely to the junction C of the two filaments 7 and 8, since there has been shown in FIG. 2 a tube 12 having two focal spots. The negative terminal A of this circuit is then connected to the conventional cup-shaped concentrating electrode 6 which surrounds the filaments 7, 8 about their sides opposite the one facing the target. The concentrating electrode 6 will then be subjected to a bias voltage which is negative relative to the cathode C of the tube, which will vary between zero value and a maximum negative value $-V_{pmax}$ which is equal to the peak-to-peak value of the voltage waveform delivered by the secondary winding 32, the d.-c. component of this bias voltage then being equal to the mean value of the voltage between the terminals A and B.

It may be desirable to vary the bias voltage $V_p$ of the concentrating electrode between a minimum negative value $-V_{pmin}$ below zero and a maximum negative value $-V_{pmax}$. This may be obtained by inserting between the terminals C (junction of the filaments 7 and 8) and B (positive terminal of the biasing arrangement) a fixed d.-c. voltage source (not shown) of small internal resistance, connected by its positive terminal to the terminal C and by its negative terminal to the terminal B. The peak-to-peak value of the voltage waveform at the terminals of winding 32 must then be equal to $(V_{pmax} - V_{pmin})$. The filaments 7, 8 are supplied in a conventional manner by a supply 10 which may comprise a transformer and the anode and the cathode C of the tube 12 are respectively connected to the positive and negative poles of a variable very high-voltage d.-c. power supply 11 which may be controlled as concerns the duration of its operation, termed a radiological generator. A spark-gap 9 respectively connected between terminals A and B protects the circuit against over-voltages.

Of course, the invention is in no way limited to the described and/or illustrated embodiments. In particular, modulation by waveforms other than those mentioned may be envisaged. The described modulation circuit may be replaced by any other device which provides substantially analogous output voltages.

What is claimed is:

1. A method for improving the definition of the focal spot of an X-ray tube having, inside of an evacuated, vacuum-tight envelope, a cathode made up from a filament for emitting electrons, an anode for accelerating and receiving said emitted electrons and for emitting an X-ray beam, and a concentrating electrode surrounding said filament on its side opposite to the one facing the anode for forming an electron beam directed towards the latter, a high-voltage direct-current supply being respectively connected to said anode and cathode, a low-voltage supply being connected to supply heating current to the filament and a bias voltage supply being connected to said concentrating electrode and said filament for controlling the shape of the emitted electron beam, while said tube is being operated, said method consisting of modulating said bias voltage by means of an alternating-current periodic voltage wave-form having a frequency of at least ten kilohertz for said concentrating electrode bias voltage to periodically vary between a minium and a maximum negative value relatively to said cathode, said minimum value being at least equal to zero, during each period of operation of said tube, whereby to periodically vary the size and shape of the focal spot substantially independently of the anode current intensity.

2. A method as claimed in claim 1, wherein a.-c. voltage waveform is symmetrical relatively to the time axis.

3. A method as claimed in claim 2, wherein said waveform is of sinusoidal shape.

4. A method as claimed in claim 2, wherein said waveform is of triangular shape.

5. A method as claimed in claim 2, wherein said waveform is of saw-tooth shape.

6. A method as claimed in claim 2, wherein said waveform is substantially a square wave.

7. A method as claimed in claim 2, wherein said waveform is of trapezoidal shape.

8. A method as claimed in claim 1, wherein the frequency of said a.-c. voltage waveform lies between 20 and 60 kilohertz.

9. In an X-ray source including: an X-ray tube having, inside of an evacuated, vacuum-tight envelope, a cathode made up from a filament for emitting electrons, an anode for accelerating and receiving said emitted electrons on a focal spot and for emitting an X-ray beam therefrom, and a concentrating electrode surrounding said filament on its side opposite to the one facing the anode for forming an electron beam directed towards the latter; a high-voltage direct-current supply having a positive pole connected to the anode and a negative pole connected to the cathode; a low-voltage supply for providing heating current to the filament; and a bias supply having terminals respectively connected to said cathode and said concentrating electrode, while said tube is being operated; a circuit arrangement for improving the definition of said focal spot comprising means for modulating said concentrating electrode bias voltage by an alternating-current voltage waveform having a frequency of at least ten kilohertz, for said bias voltage to vary between a minimum and maximum negative value, said minimum value being at least equal to zero, during each period of operation of said tube, whereby to periodically vary the size and shape of the focal spot substantially independently from the anode current intensity.

10. A circuit arrangement as claimed in claim 9, wherein said bias voltage modulating means comprises a signal generator for delivering periodic signals having a variable waveform, amplitude and frequency; a variable gain amplifier fed by the generator and by a variable d.-c. voltage source for controlling its gain; a transformer having a primary winding fed by said amplifier and a secondary winding having one of its terminals directly connected to the cathode of the X-ray tube and to the cathode of a diode, for clamping the positive peaks of said waveform to the cathode potential, and having its other terminal connected through a capacitor to the anode of the diode and to the concentrating electrode so as to vary the biasing voltage thereof relatively to the cathode of the tube between zero volts and a negative peak value substantially equal to the peak-to-peak amplitude of the voltage waveform across the secondary winding of the transformer.

* * * * *